US007775776B2

(12) United States Patent
Bolding

(10) Patent No.: US 7,775,776 B2
(45) Date of Patent: Aug. 17, 2010

(54) METHOD AND APPARATUS TO PUMP LIQUIDS FROM A WELL

(75) Inventor: Jeffrey L. Bolding, Kilgore, TX (US)

(73) Assignee: BJ Services Company, U.S.A., Houston, TX (US)

( * ) Notice: Subject to any disclaimer, the term of this patent is extended or adjusted under 35 U.S.C. 154(b) by 908 days.

(21) Appl. No.: 11/463,937

(22) Filed: Aug. 11, 2006

(65) Prior Publication Data

US 2007/0039740 A1 Feb. 22, 2007

Related U.S. Application Data

(60) Provisional application No. 60/595,958, filed on Aug. 19, 2005.

(51) Int. Cl.
*F04B 19/00* (2006.01)
*F04B 9/10* (2006.01)
*E21B 43/00* (2006.01)

(52) U.S. Cl. ..... 417/329; 417/385; 417/390; 166/68.5; 166/370; 166/372

(58) Field of Classification Search ..... 417/328, 417/329, 385, 390, 904; 166/68.5, 105, 370, 166/372

See application file for complete search history.

(56) References Cited

U.S. PATENT DOCUMENTS

| | | | | |
|---|---|---|---|---|
| 4,490,095 | A * | 12/1984 | Soderberg | 417/46 |
| 4,616,981 | A * | 10/1986 | Simmons et al. | 417/378 |
| 5,915,475 | A | 6/1999 | Wells et al. | |
| 6,467,541 | B1 | 10/2002 | Wells | |
| 2005/0022998 | A1 | 2/2005 | Rogers, Jr. | |
| 2005/0175476 | A1 | 8/2005 | Patterson | |
| 2005/0249613 | A1 | 11/2005 | Jordan et al. | |
| 2006/0008364 | A1 | 1/2006 | Traylor | |

OTHER PUBLICATIONS

PCT International Search Report, Jul. 26, 2007.

* cited by examiner

*Primary Examiner*—Charles G Freay
(74) *Attorney, Agent, or Firm*—Zarian Midgley & Johnson PLLC

(57) ABSTRACT

A single conduit lift pump is disclosed that only requires a single fluid conduit for both the driving fluid and the pumping action of the pump in a well bore. Fluid pressure communicated to the pump by the single fluid conduit drives the pump to load a resilient member. The fluid pressure is cycled off to allowing the lift of fluid by action of the resilient member upon the single fluid conduit. The single fluid conduit makes this pump suitable for downhole operations for the oil and gas production industries in wells that have substantial water cut that inhibits the production of gas.

7 Claims, 5 Drawing Sheets

METHOD AND APPARATUS TO PUMP LIQUIDS FROM A WELL

CROSS-REFERENCE TO RELATED APPLICATIONS

This is non-provisional of U.S. patent application Ser. No. 60/595,958, filed 19 Aug. 2005, which is incorporated herein by reference in its entirety and to which priority is claimed.

FIELD OF THE INVENTION

The present invention relates to a pump system to remove fluids from a well; specifically, to a suspended single conductor pump located in a well bore that is connected to a surface pump that pumps fluid down the single conductor to energize the pump. Upon termination of the surface pump pressure, resilient forces in the subsurface single conductor pump move the fluid out of the well bore to the surface.

BACKGROUND OF THE INVENTION

Pneumatically or hydraulically powered pumps have been in use for many years by varying industries. In particular, pneumatically or hydraulically powered pumps have found widespread uses in the chemical, petroleum, petrochemical, general industrial, agricultural, and residential areas. The typical operation of a hydraulic or pneumatic pump is to expand a diaphragm or other expandable chamber using compressed air or fluid such that the fluid is expelled as the chamber expands causing a pumping action. In partially depleted oil and gas wells, the flow of liquids into the well bore often causes the well to cease flowing under its own pressure, due to the hydrostatic weight of the fluid it is attempting to produce. It is estimated that approximately twenty-five percent of oil and gas reserves, remain after these wells stop flowing under their own pressure. In order to increase production rates of a given well, the flowing bottom hole pressure must be reduced. This reduced flowing bottom hole pressure will increase the pressure differential between the formation and the well bore which will accelerate the migration of oil and gas to the well bore. If the non-flowing or liquid loaded well can have it's liquids lifted, much of the remaining oil and gas can be recovered and the well will not be required to be plugged and abandoned, which requires substantial effort and expense.

SUMMARY OF THE PRESENT DISCLOSURE

A fluid transport or fluid lift pump apparatus includes a first enclosed body forming a driving piston chamber, divided by a sealed first piston head into a first fluid chamber having a fluid port and a first resistance chamber; a second enclosed body forming an accumulator chamber, divided by a sealed second piston head into a second fluid chamber and a second resistance chamber, the second fluid chamber having a fluid ingress port and a fluid egress port; a piston rod rigidly connecting the first piston head and second piston head; an ingress check valve in communication with the fluid ingress port, permitting flow into the second fluid chamber; and an egress check valve in communication with the fluid egress port and the fluid port, permitting flow out of the second fluid chamber. The first resistance and the second resistance chambers can either or both contain pressurized fluid such as nitrogen. The first resistance chamber can also include a first resistance fluid port and the second resistance chamber includes a second resistance fluid port. A spring may be used within the first or second resistance chamber or in both chambers to provide restoration charging position. A conduit having a first and second end, force to move the piston to the second end in communication with the fluid port and the egress check valve can be used to allow fluid to be drawn from the well to the surface to remove a hydrostatic head from a mature oil and gas well. A 3-way valve in communication with the first end of the conduit can be used on the surface to switch the single conduit from flowing into the well to flowing out of the well or into a tank farm for storage.

In one embodiment, a fluid lift pump for transporting fluid is assembled by combining a driving chamber having an expansion means therein and a fluid port; an accumulation chamber having an expansion means therein, an ingress port, and an egress port; a means for connecting the driving chamber and accumulation chamber such that an expansion of the driving chamber causes an expansion of the accumulation chamber; an ingress means in communication with the ingress port for allowing fluid to the accumulation chamber while not allowing fluid to exit the accumulation chamber; and an egress means in communication with the egress port and the fluid port for allowing fluid to exit the accumulation chamber while not allowing fluid to enter the accumulation chamber.

In another embodiment, a single port fluid lift pump includes a first enclosed body forming a driving chamber, divided by a sealed first piston head into a first fluid chamber having a single fluid port and a first resistance chamber; a second enclosed body forming an accumulator chamber, divided by a sealed second piston head into a second fluid chamber, having a fluid ingress port and a fluid egress port, and a second resistance chamber; a piston rod rigidly connecting the first piston head and second piston head; an ingress check valve operably connected to the fluid ingress port, permitting flow into the second fluid chamber; and an egress check valve operably connected to the fluid egress port, and in communication with the fluid port, permitting flow out of the second fluid chamber.

A method of removing or transporting fluid from a well can be accomplished by providing a first enclosed body forming a driving chamber, divided by a sealed first piston head into a first fluid chamber having a fluid port and a first resistance chamber; providing a second enclosed body forming an accumulator chamber, divided by a sealed second piston head into a second fluid chamber, having a fluid ingress port and a fluid egress port, and a second resistance chamber; operably connecting the first piston head to the second piston head; operably connecting an ingress check valve to the fluid ingress port to permit flow into the second fluid chamber; operably connecting an egress check valve to be in communication with the fluid egress port and the fluid port to permit flow out of the second fluid chamber; placing the ingress check valve in communication with a fluid to be transported; displacing the first piston from its natural position to enlarge the first fluid chamber and the second fluid chamber; and allowing the first piston to return to its natural position.

Similarly, a method of increasing well production can be accomplished by connecting one end of a conduit to a valve in communication with a pressurized fluid source; connecting the opposite end of the conduit to a single port fluid lift pump; inserting the single the conduit; and releasing port fluid lift pump into a fluid reservoir within a well; pressurizing the pressure within the conduit.

Alternatively, a method of pumping fluid from a well connecting one end of a fluid transport means to a valve in I can be performed by communication with a pressurized fluid source; connecting the opposite end of the fluid transport means to a single port fluid lift means; inserting the fluid lift means into a fluid reservoir; pressurizing the fluid transport means; and releasing the pressure within the fluid transport means.

In one embodiment, a lift pump can also be provided by combining a sealed driving piston connected to a single fluid conductor reactive to hydraulic force applied on the single fluid conductor; a pumping piston having a fluid ingress port connected to an exterior of the pump and a fluid egress port connected to the single fluid conductor; a connector between the driving piston and the pumping piston responsively moving the pumping piston as the sealed driving piston is filled with fluid to move fluid into the pumping piston from the ingress port; and, a resilient chamber causing the pumping piston to move fluid out of the egress port into the single fluid conductor when hydraulic force is no longer applied on the single fluid conductor.

This type of pump is charged and operated by installing the single conduit pump in a well bore in a well to a desired point below the surface; placing a C-clamp connector on the pump, which is connected to a source of nitrogen, in order to charge the resilient chamber; and connecting a conduit to the proximal end of the pump and lowering the pump into the well production zone. Alternatively, the single conduit pump could be connected to the conduit and installed in the wellhead to a point allowing the operator to charge the pump with a compressible gas such as nitrogen, then lowered down the well bore into the fluid production zone of the well.

A method for producing liquids from a well bore with a single conduit pump can be accomplished by the steps of inserting the pump assembly to the production zone; enabling the surface motor to pressurize the single conduit with fluid on a cyclical basis; and, adjusting the valves of the surface collection assembly to cycle consistent with the pump cycle.

The fluid transport apparatus and single conduit pump of the present disclosure can accelerate recovery of hydrocarbons, reduce the abandonment pressure, and increase the total cumulative production. The single conduit pump uses the single conduit or tube as both the power input conduit and the produced fluid output conduit utilizing no vents to lift the liquids from the production zone and thereby enhance the production rate of the well.

The single conduit pump system is hung rather than seated in a pre-existing seat. Thus, the single conduit pump eliminates the need for multiple conduits to permit the flow of fluids to the surface. Since the pump is inserted on a single conduit into the well bore, the deployment of the pump may be done without substantial expensive equipment typically used for most pump deployment systems. The cost of both deployment and for the pump and conduit are therefore substantially less than the cost of prior pump systems.

DETAILED DESCRIPTION

Figure 1:
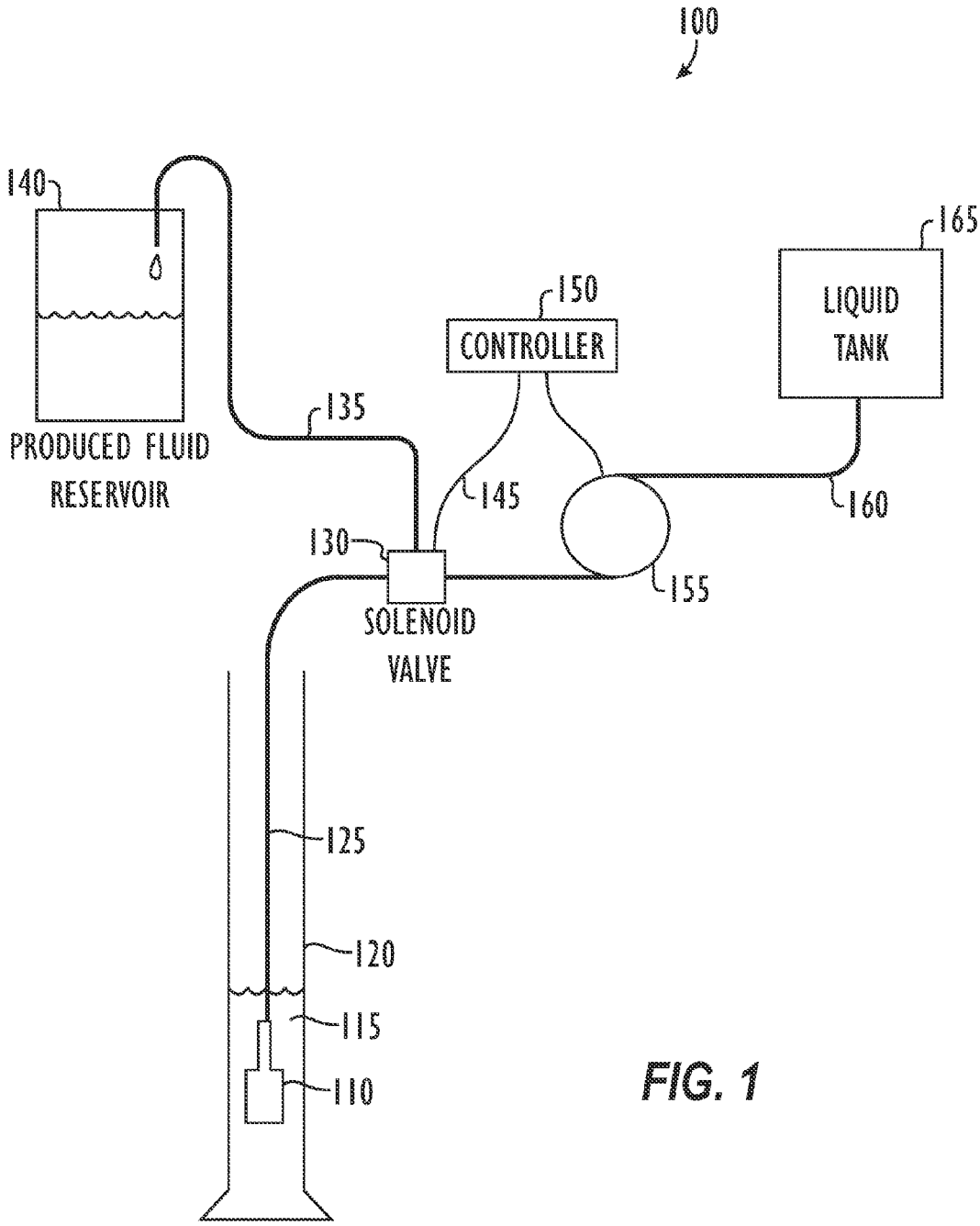
FIG. 1 is a diagram of an embodiment of a fluid transport apparatus or system having a single conduit pump according to certain teachings of the present disclosure.

FIG. 1 shows an embodiment of a fluid transport apparatus or system 100 having a single conduit pump 110 according to certain teachings of the present disclosure. The single conduit pump 110 can be inserted into an oil or gas well 120. The single conduit pump can be inserted and suspended by a tube 125 connecting the single conduit pump 110 to the surface. The single conduit pump 110 can be submersed into fluid 115 at the bottom of the oil or gas well 120. This fluid 115 is typically oil, water, or a mixture thereof but can consist of any type of fluid.

The tube 125 typically used to connect the improved water cut lift pump 110 to the surface equipment can be connected to a three-way solenoid valve 130. The three-way valve 130 can be operated by the controller 150 such that in one position, the tube 125 connected to the single conduit pump 110 is in communication with the liquid tank 165 via pump or compressor 155 and line 160. In the opposite position, the three-way valve 130 can perform the function of placing the tube 125 connected to the single conduit pump 110 in communication with the produced fluid reservoir 140 via line 135. The three-way valve 130 is not to be construed as limited to only that configuration. Any other configuration that performs the same function can be used with the system 100. For example, two valves and appropriate piping could perform an identical function. In addition, control valves can be used if desired. Controller 150 can be any type of controller for actuating a solenoid valve that is known in the art including, but not limited to, pneumatic or electrically actuated. Line 145 can be any type of transmission line that is suitable for the operation of controller 150. For example, in the case of an electrical controller, line 145 can be a wire. In the case of a pneumatic controller, the line 145 can be a pipe or tube.

The system 100 shown in FIG. 1 can operate to pump fluid 115 from the bottom of the well 120. While single conduit pump 110 is filling with fluid 115 from the bottom of well 120, the three-way valve 130 is actuated such that liquid tank 165 is in communication with the tube 125. This allows pump 155 to apply force to the piston in the single conduit pump 110 thus filling pump 110 with fluid 115 from the bottom of the well 120. Once controller 150 detects that pump 110 has pumped its prescribed displacement volume with fluid 115, the controller 150 will send a signal via line 145 to the three-way valve 130 placing the tube 125 in communication with the produced fluid reservoir 140. The change in the position of the three-way valve 130 will allow the single conduit pump 110 to pump fluid 115 from the bottom of the well 120 into the produced fluid reservoir 140 via the tube 125 and line 135. Once no more fluid is being produced to the produced fluid reservoir 140, the controller will actuate the three-way valve and the process can repeat itself.

Figure 2:
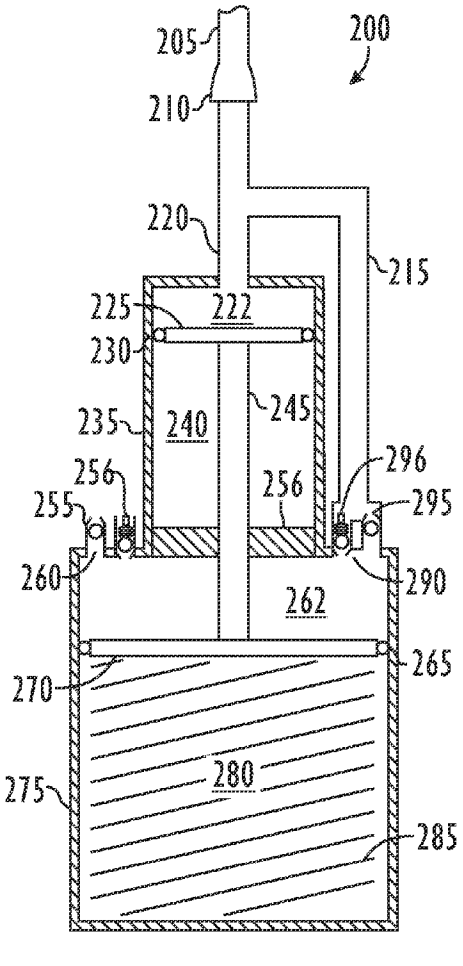
FIG. 2 is a schematic diagram of one embodiment of a single conduit pump with a sealed resilient chamber.

FIG. 2 depicts a schematic of one embodiment of an single conduit pump 200. A conduit or tube 205 is attached to the first end of a single fluid conductor 220 by connector 210. The single fluid conductor 220 is also connected to the fluid egress port 290 via fluid egress check valve 295 and line 215. The second end of the single fluid conductor 220 is connected to the upper chamber 222 of the sealed driving piston 235. The sealed driving piston 235 also contains a lower chamber 240 separated from the upper chamber 222 by driving piston head 225 and dynamic seal 230. The driving piston head 225 is connected to the pumping piston head 270 by piston rod 245 through seal 250. The seal 250 can consist of a rigid wall with a seal around the piston rod 245 or a seal separating the driving piston 235 from the pumping piston 275.

The pumping piston 275 has an inlet port 260 in communication with an inlet check valve 255 allowing fluid to enter the pumping chamber 262. Pumping piston 275 also has an egress port 290 in communication with an egress check valve 295 allowing fluid to exit the pumping chamber 262. Pumping chamber 262 is separated from the resilient chamber 280 by pumping piston head 270 and dynamic seal 265. Resilient chamber 280 further contains a spring or other elastic medium 285. In addition, resilient chamber 280 may also include a pressurized gas charge.

Additional check valves 296 and 256 can be included to allow gas lock occurring in chamber 262 to be overcome by pumping additional fluid down conductor 205 at a substantially higher pressure than experienced by check valves 295 and 255. This additional pressure would drive fluid into chamber 262 and any entrained gas bubble out valve 256 thereby restoring the pump to full operating capacity.

In operation, the single conduit pump 200 in FIG. 2 only requires a single tube from the top of the well to the pump but is still able to pump effectively and in the case of a gas well, allows the gas to flow up the annulus formed around the single tube and the production casing or production tubing. Fluid is pumped down the conduit 205 and through connector 210 to fill the single fluid conductor 220 and line 215. Egress check valve 295 prevents fluid from entering the pumping piston from the tube. As fluid continues to pump down the tube and through single fluid conductor 220 into the upper driving piston chamber 222, the driving piston head 225 moves downward pushing the pumping piston head 270 downward. As the pumping piston head 270 moves downward, fluid from the well enters the pumping chamber 262 through ingress check valve 255 and ingress port 260. This continues until the force being exerted by the fluid pressure on the driving piston head 225 is equal the force being exerted by the resilient chamber 280 on the pumping piston head 270. At this point, additional fluid being pumped by the conduit 205 has no further effect unless the pressure is increased. Once the pumping chamber is filled or at least partially filled, the pressure on the conduit 205 can be released by a controller on the surface. At this point, the resilient chamber is exerting a much greater force on the pumping piston head 270 than being exerted on the driving piston head 225. The ingress check valve 255 prevents fluid from exiting the pumping chamber 262 via the ingress port 260. The only exit for the fluid is through egress port 290 and egress check valve 295 via line 215. As fluid is pushed out of the pumping chamber 262, it is forced into the single conductor 220 and up the conduit 205.

The volume of one input cycle will be substantially less than the volume of one output cycle since the driving piston has a much smaller volume than the pumping piston. By way of multiple repetitions, eventually this system will be full, from bottom to top with only produced fluid from the well, save and except for a small volume from the surface pump to the 3-way valve, which will only contain the surface pumping fluid.

Figure 3:
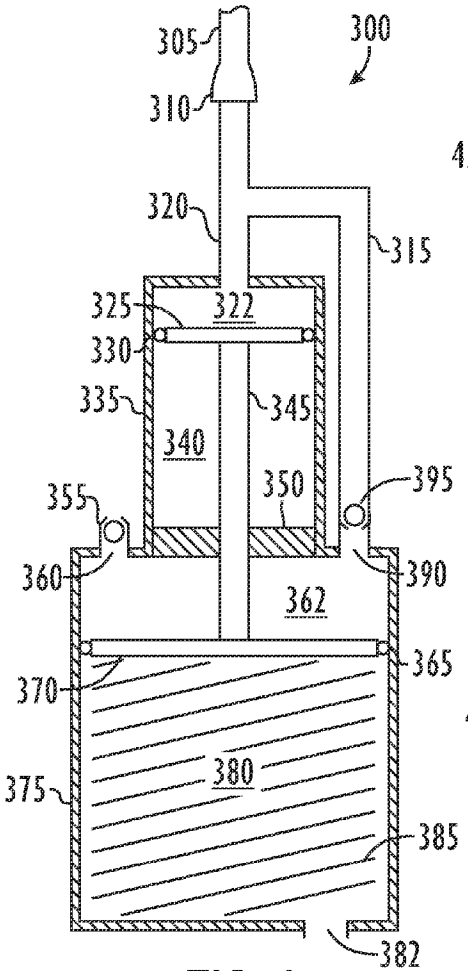
FIG. 3 is a schematic diagram of another embodiment of a single conduit pump where a resilient chamber is exposed to a fluid to be pumped.

FIG. 3 depicts a schematic of another embodiment of an single conduit pump 300. FIG. 3 is very similar to FIG. 2 with only minor differences. A conduit 305 is attached to the first end of a single fluid conductor 320 by connector 310. The single fluid conductor 320 is also connected to the fluid egress port 390 via fluid egress check valve 395 and line 315. The second end of the single fluid conductor 320 is connected to the upper chamber 322 of the sealed driving piston 335. The sealed driving piston 335 also contains a lower chamber 340 separated from the upper chamber 322 by driving piston head 325 and dynamic seal 330. The driving piston head 325 is connected to the pumping piston head 370 by piston rod 345 through seal 350. The seal 350 can consist of a rigid wall with a seal around the piston rod 345 or a seal separating the driving piston 335 from the pumping piston 375.

The pumping piston check valve 355 allowing fluid 375 has an inlet port 360 in communication with an inlet to enter the pumping chamber 362. Pumping piston 375 also has an egress port 390 in communication with an egress check valve 395 allowing fluid to exit the pumping chamber 362. Pumping chamber 362 is separated from the resilient chamber 380 by pumping piston head 370 and dynamic seal 365. Resilient chamber 380 further contains a spring or other elastic medium 385. In addition, resilient chamber 380 can include a port 382 allowing the fluid to be pumped to fill the resilient chamber such that the pressure at the bottom of the well can be used as a portion of the elastic medium for the resilient chamber 380.

In operation, the single conduit pump 300 in FIG. 3 only requires a single conduit 305 from the top of the well to the pump 300 but is still able to pump effectively. Fluid is pumped down conduit 305 and through connector 310 to fill single fluid conductor 320 and line 315. Egress check valve 395 prevents fluid from entering the pumping piston from the conduit 305. As fluid continues to pump down the conduit 305 and through single fluid conductor 320 into the upper driving piston chamber 322, the driving piston head 325 moves downward pushing the pumping piston head 370 downward. As the pumping piston head 370 moves downward, fluid from the well enters the pumping chamber 362 through ingress check valve 355 and ingress port 360. This continues until the force being exerted by the fluid pressure on the driving piston head 325 is equal the force being exerted by the resilient chamber 380 on the pumping piston head 370. At this point, additional fluid being pumped by the conduit 305 has no further effect unless the pressure is increased. Once the pumping chamber is filled or at least partially filled, the pressure on the conduit 305 can be released by a controller on the surface. At this point, the resilient chamber is exerting a much greater force on the pumping piston head 370 than being exerted on the driving piston head 325. The ingress check valve 355 prevents fluid from exiting the pumping chamber 362 via the ingress port 360. The only exit for the fluid is through egress port 390 and egress check valve 395 via line 315. As fluid is pushed out of the pumping chamber 362, it is pushed into the single conductor 320 and up the conduit 305.

Figure 4:
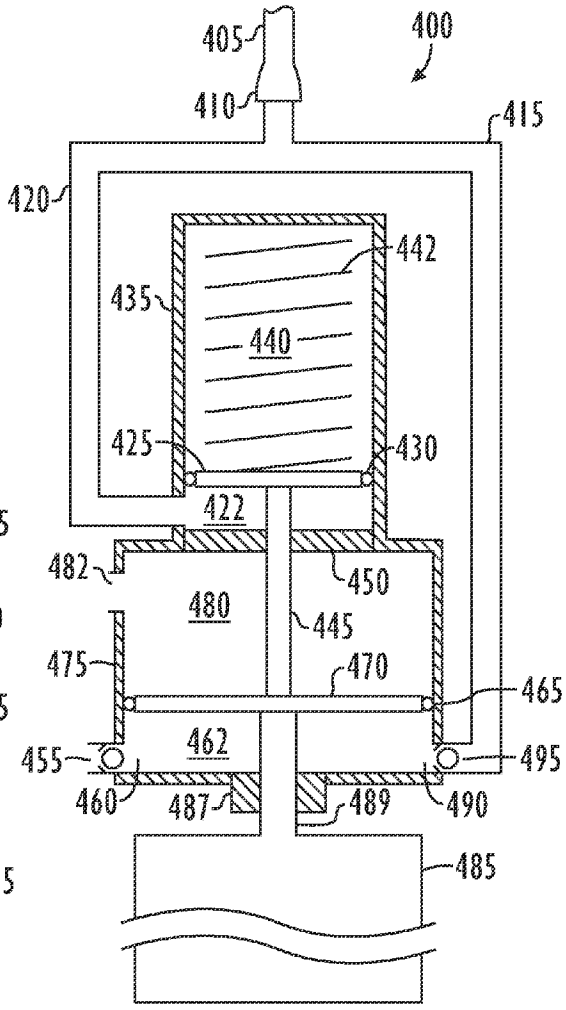
FIG. 4 is a schematic diagram of an alternative embodiment of a single conduit pump where a resilient chamber is inverted.

FIG. 4 depicts a schematic of another embodiment of an single conduit pump 400. FIG. 4 is similar to FIGS. 2 and 3, but the resilient chamber is part of the driving piston and a weight is used to supplement the resistance. A conduit 405 is attached to the first end of a single fluid conductor 420 by connector 410. The single fluid conductor 420 is also connected to the fluid egress port 490 via fluid egress check valve 495 and line 415. The second end of the single fluid conductor 420 is connected to the lower chamber 422 of the sealed driving piston 435. The sealed driving piston 435 also contains an upper resilient chamber 440 separated from the lower chamber 422 by driving piston head 425 and dynamic seal 430. Resilient chamber 440 further contains a spring or other elastic medium 442. In addition, resilient chamber 440 may also include a pressurized gas charge. One alternative could use the bottom hole pressure as used in FIG. 3 as an additional force aid. The driving piston head 425 is connected to the pumping piston head 470 by piston rod 445 through seal 450. The seal 450 can consist of a rigid wall with a seal around the piston rod 445 or a seal separating the driving piston 435 from the pumping piston 475.

The pumping piston 475 has an inlet port 460 in communication with an inlet check valve 455 allowing fluid to enter the pumping chamber 462. Pumping piston 475 also has an egress port 490 in communication with an egress check valve 495 allowing fluid to exit the pumping chamber 462. Pumping chamber 462 is separated from the resilient chamber 480 by pumping piston head 470 and dynamic seal 465. The resilient chamber 480 in this embodiment includes a port 482 open to the fluid in the bottom of the well. This allows the pressure at the bottom of the well to be used as an additional force aid to pump the fluid to the surface on the pumping stroke. In addition, other resilient means such as a spring could be utilized in resilient chamber 480. The embodiment of FIG. 4 further includes a weight 485 connected to the pumping piston head 470 by the weight piston rod 489. The weight is outside the pumping piston chamber and the weight piston rod protrudes through the wall of the pumping piston 470 and is sealed by seal 487.

In operation, the single conduit pump 400 of FIG. 4 only requires a single conduit 405 from the top of the well to the pump but is still able to pump effectively. Fluid is pumped down the conduit 405 and through connector 410 to fill single fluid conductor 420 and line 415. Egress check valve 495 prevents fluid from entering the pumping piston from the conduit 405. As fluid continues to pump down the conduit 405 and through single fluid conductor 420 into the lower driving piston chamber 422, the driving piston head 425 moves upward, pushing the pumping piston head 470 upward. As the pumping piston head 470 moves upward, fluid from the well enters the pumping chamber 462 through ingress check valve 455 and ingress port 460. This continues until the force being exerted by the fluid pressure on the driving piston head 425 is equal the forces being exerted against the driving piston head or until a pre-defined volume has been pumped via the surface controller. These forces include the force exerted downward by the resilient chamber 440 on the driving piston head 425, the force being exerted downward on the pumping piston head 470 by the resilient chamber 480, and the force being exerted downward by the weight 485 on the pumping piston. At this point, additional fluid being supplied by the conduit 405 has no further effect unless the pressure is increased. Once the pumping chamber is filled or at least partially filled, the pressure on the conduit 405 can be released by a controller on the surface. At this point, the resilient chamber 440, the resilient chamber 480, and the weight 485 are exerting a much greater force downward on the driving piston head 425 than being exerted upward on the driving piston head 425 by the pumping piston head 470. The ingress check valve 455 prevents fluid from exiting the pumping chamber 462 via the ingress port 460. The only exit for the fluid is through egress port 490 and egress check valve 495 via line 415. As fluid is pushed out of the pumping chamber 462, it is pumped into the single conductor 420 and up the conduit 405.

Figure 5:
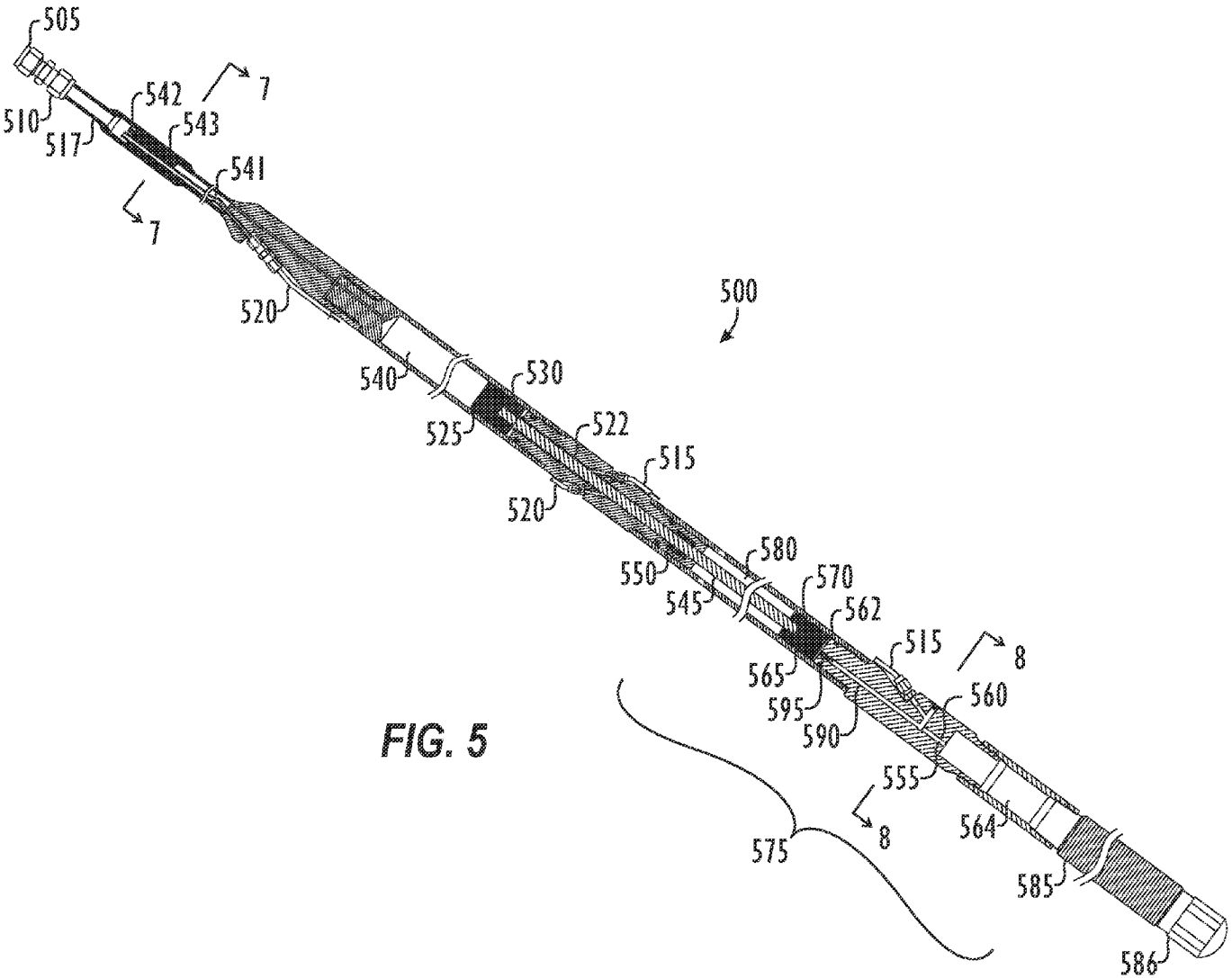
FIG. 5 is a mechanical diagram of an additional embodiment of a single conduit pump.

FIG. 5 depicts a mechanical drawing of another embodiment of a single conduit lift pump 500 according to the present disclosure. FIGS. 6A-6E depict enlarged sections of the pump 500 of FIG. 5 utilizing the same numbering scheme. The embodiment of the pump 500 in FIG. 5 contains many of the features shown in the embodiment of FIG. 4, but represents a departure from the prior described embodiments of the pump. In FIG. 5, a conduit 505 is attached to the first end of a single fluid conductor 520 by connector 510. The single fluid conductor 520 is also connected to the fluid egress port 590 via lower chamber 522 of sealed driving piston 535. The lower chamber 522 is further in communication with fluid egress check valve 595 via line 515.

Figure 6A:
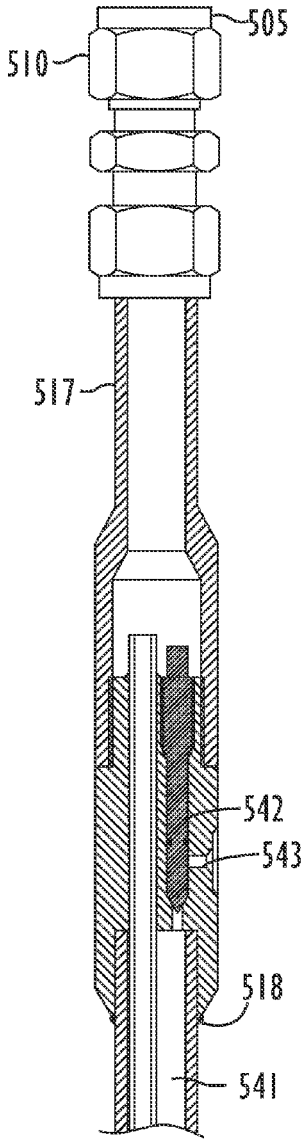
FIGS. 6A-6E are enlarged views of FIG. 5 showing additional detail.
Figure 6B:
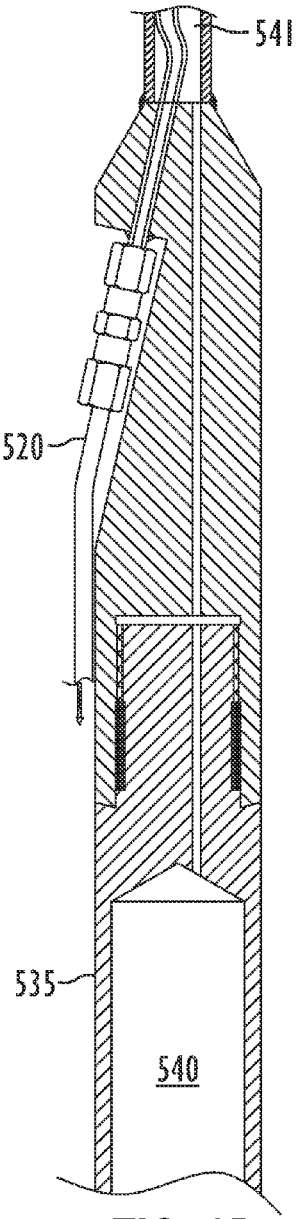
Figure 6C:
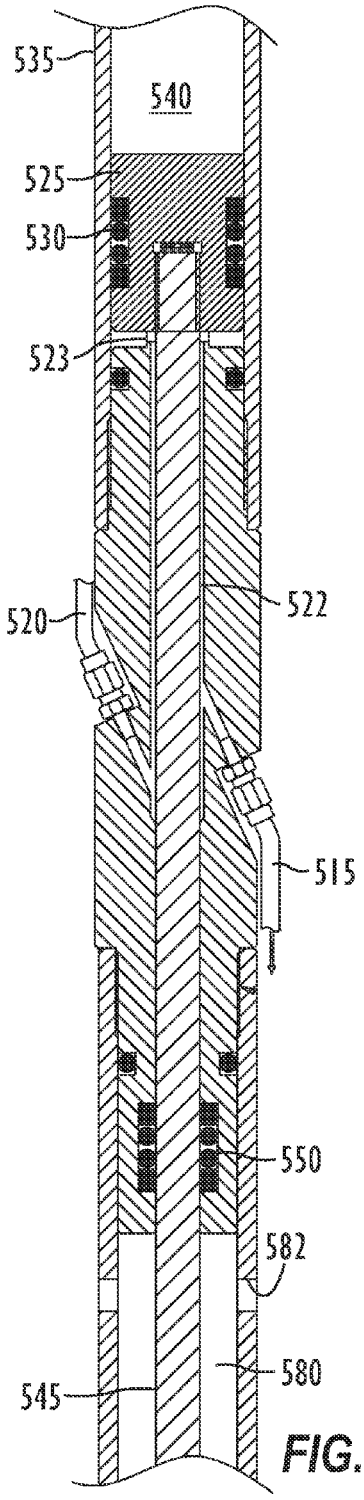
Figure 6D:
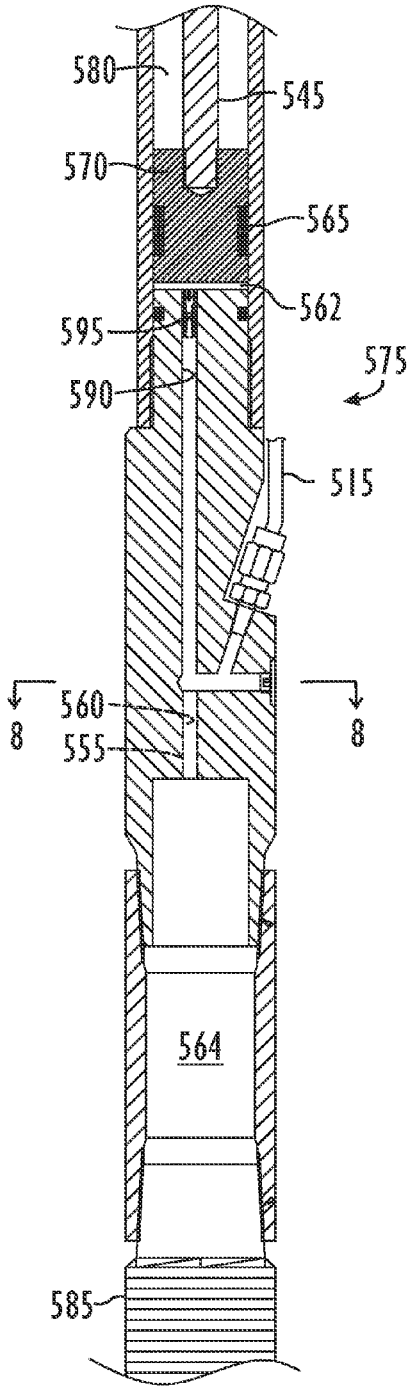
Figure 6E:
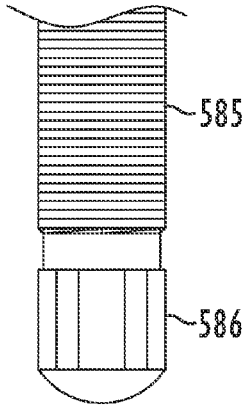

The sealed driving piston 535 also contains an upper chamber 540 separated from the lower chamber 580 by driving piston head 525, piston rod 545 and dynamic seal 530. Chamber 540 contains a pressurized gas charge. The driving piston head 525 is connected to the pumping piston head 570 by piston rod 545 through seal 550. The seal 550 can consist of a rigid wall with a seal around the piston rod 545 or a seal separating the driving piston 535 from the pumping piston 575. A charge of gas, such as nitrogen, is maintained on upper chamber 540 from reservoir 541 that is charged at the surface in preparation of lowering the pump 500 into the well through a port, more clearly shown in FIG. 7 at cross-sectional area 7-7 of FIG. 5. Upon charging reservoir 541 with a pressurized gas, plug 542 is screwed into place as shown in FIG. 6A. Upon installing plug 542, pump body cap 517 is screwed into place. After pump body cap 517 is installed, the pump can be fully charged into the well to commence operations.

The gas is charged through gas charge port 543 while plug 542 is unscrewed (not shown). Upon achieving the desired pressure in reservoir 541, the plug 542 is screwed into place to seal the reservoir and maintain the pressure. Upon charging reservoir 541 and screwing plug 542 into place, the pump body cap 517 is screwed into position, and the pump lowered into the well, before pumping operations can commence.

The depth of the well and the physical characteristics of the fluid (brine) to be lifted from the well are measure by methods well known to those skilled in this art. Accordingly, the reservoir 541 may be made shorter or longer to provide sufficient gas pressure on upper chamber 540 to drive the piston head 525 in the recharge phase of the pump. Lower chamber 522 contains an enlarged cavity 523 adjacent to driving piston head 525 to allow the fluid entering through single fluid conductor 520 to more easily displace driving piston head 525. Relieving the hydrostatic head on the single conduit 505 by action of the pump (155; FIG. 1) at the surface, permits the lift of the fluid from the well to the surface.

The pumping piston 575 has an inlet port 560 (more clearly shown in FIG. 8) in communication with an inlet check valve 555 (not shown on drawing, although approximate location labeled) allowing fluid to enter the pumping chamber 562 through screen 585 and cavity 564. Bull nose plug 586 closes the bottom of the pump 500 and prevents debris in the wellbore 120 from clogging pump 500. Pumping piston 575 also has an egress port 590 in communication with an egress check valve 595 allowing fluid to exit the pumping chamber 562 through line 515, lower chamber 522, single fluid conductor 520, and conduit 505. The pumping chamber 562 is separated from the chamber 580 by pumping piston head 570 and dynamic seal 565. The chamber 580 has openings 582 to communicate with the environment outside the pump 500. In addition, other resilient means such as a spring or pressurized gas charge could be utilized in chamber 580.

Installation of the single conduit pump 500 is typically performed by installing a substantial portion of the pump 500 into the oil or gas well 120. This is typically done because the pump 500 can be extremely long an unwieldy, depending on the well characteristics and the sizes of the various chambers and reservoirs. Typically, the pump is installed in the well 120 to approximately the clamping point 518, a shoulder on the proximal end of the charging chamber. The clamping point allows an operator to temporarily clamp the pump to prevent further movement into the well bore, yet allow access to the charging port 543.

Upon installing the pump 500 into well 120 up to clamping point 543, the gas is charged into reservoir 541 through gas charge port 543 while plug 543 is only partially screwed into place. Plug 542 must initially be installed to prevent gas leakage but allow charging of gas through gas charge port 543. Upon obtaining the desired pressure in reservoir 541, plug 542 is fully screwed into place to seal off gas charge port 543. Upon gas charge port 543 being sealed, the gas charge can be removed and the pump body cap 517 can be installed. Once this is completed, the pump 500 can be fully installed into the well 120.

In operation, the single conduit pump 500 of FIG. 5 only requires a single conduit 505. Fluid is pumped down the conduit 505 and through connector 510 to fill the single fluid conductor 520, lower chamber 522, and line 515 up to check valve 595. Egress check valve 595 prevents fluid from entering the pumping piston from the conduit 505. As fluid continues to pump down the conduit 505 and through single fluid conductor 520 into the lower driving piston chamber 522, the driving piston head 525 moves upward against the force of the pressurized gas charge in resilient chamber 540, pushing the pumping piston head 570 upward. As the pumping piston head 570 moves upward, fluid from the well enters the pumping chamber 562 through screen 585, cavity 564, ingress port 560, and ingress check valve 555 (more clearly depicted in FIG. 8). This continues until the force being exerted by the fluid pressure on the driving piston head 525 is equal the forces being exerted against the driving piston head or until a pre-defined volume has been pumped by the surface pump (155; FIG. 1) via a surface controller (150; FIG. 1). These forces include the force exerted downward by the gas-filling chamber 540 on the driving piston head 525 and the force being exerted downward on the pumping piston head 570 by the chamber 580. At this point, additional fluid being supplied by the conduit 505 has no further effect unless the pressure is increased. Once the pumping chamber is filled or at least partially filled, the pressure on the conduit 505 can be released by the controller (150) on the surface. As the pressure in conduit 505 is released by controller (150), the chamber 540 restores equilibrium by exerting force on the driving piston head 525 causing the pumping piston head to force fluid from pumping chamber 562 through egress port 590 and egress check valve 595. The ingress check valve 555 prevents fluid from exiting the pumping chamber 562 via the ingress port 460. The only exit for the fluid is through egress port 590 and egress check valve 595 via line 515, lower driving piston chamber 522, single fluid conductor 520, and conduit 505. As fluid is continually pushed out of the pumping chamber 562, it is pushed into the single conductor 520 and up the conduit 505. Once the pump stops producing fluid at an acceptable rate, the process is repeated again.

Figure 7:
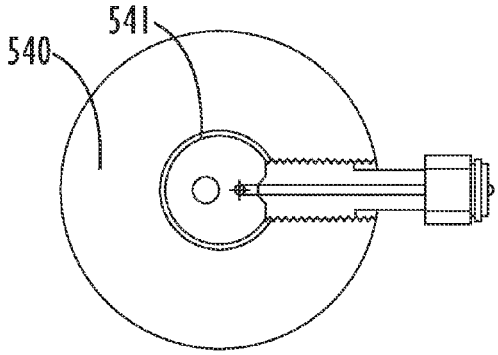
FIG. 7 is a cross-section through the line 7-7 of the diagram of FIG. 5.

FIG. 7 depicts an enlarged view of the gas charging port for reservoir 541. This port can be used to charge a high-pressure gas such as nitrogen into the reservoir to supply chamber 540 before deployment of the pump or after deployment if a pressurized gas line is installed. Reservoir 541 can be several meters to several hundred meters in length depending on the well characteristics.

Figure 8:
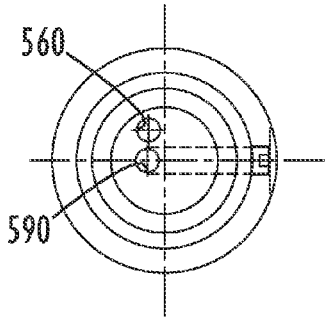
FIG. 8 is a cross-section through the line 8-8 of the diagram of FIG. 5.

FIG. 8 depicts an enlarged, cross-sectional view of the embodiment of FIG. 5. FIG. 8 depicts that fluid egress port 590 and fluid ingress port 560 are actually two separate lines that appear as a single line on FIG. 5. Fluid is drawn from fluid cavity 564 into pumping chamber 562, then exits the chamber 562 into egress line 590 through back-flow valve 595 and from there through line 515 up the well to the surface.

It may be readily appreciated that the single conduit pump can be suspended through a subsurface safety valve system; or it may be suspended in the subsurface safety valve.

The above embodiments describe possible examples of the subject matter of the present disclosure and should not be construed as limitations. There are many additional possibilities of how to arrange the resilient chamber and driving chamber that will allow the disclosed pump to function in the same manner. In addition, the pistons described herein, it is possible to use any type of resilient chamber such as a diaphragm or other resilient means known in the art. Every possible combination has not been included and described. Sufficient examples have been described to demonstrate that many different possibilities exist for the actual construction of the subject matter of the present disclosure. In addition, while the embodiment described herein refer to pumping well fluids, the single conduit pump described herein and its method of use could be applied to other applications where a single conductor pump might be beneficial.

What is claimed is:

1. A fluid transport apparatus, comprising:

a surface pump;

a surface valve in fluid communication with the surface pump and a reservoir; and a subsurface pump in fluid communication with the surface valve via a single conduit extending from the surface valve and positionable in well fluid, wherein the subsurface pump is configured to be charged with the well fluid by pressure applied to the single conduit from the surface pump, wherein the subsurface pump is configured to discharge the charged well fluid into the single conduit when pressure from the surface pump is removed; and wherein the surface valve is operable to divert fluid into the single conduit when the surface pump is operated and to divert fluid flowing from the single conduit into the reservoir.

2. The apparatus of claim 1, further comprising a controller operating the surface valve in a first state to allow the surface pump to apply pressure to the single conduit and in a second state to allow discharging from the subsurface pump into the reservoir.

3. The apparatus of claim 1, further comprising a fluid source in communication with the surface pump and providing fluid for the surface pump to apply pressure to the single conduit.

4. The apparatus of claim 1, wherein the subsurface pump comprises:

a pump body in communication with the single conduit;

an enclosed first piston in the pump body responsive to pressure pumped from the surface; and an enclosed second piston in the pump body connected to the enclosed first piston, the second piston responsive to a resilient force, whereby the first piston is configured to move in response to pressure applied by the surface pump to the single conduit and fill a chamber with the well fluid, and whereby the resilient force is configured to move the fluid out of the pump body into the single conduit when pressure from the surface pump is removed.

5. The apparatus of claim 4, wherein the subsurface pump further comprises a resilient chamber in fluid communication with the exterior of the subsurface pump.

6. The apparatus of claim 4, wherein the subsurface single conduit pump further comprises a resilient chamber adjacent the enclosed first piston, the resilient chamber resisting movement of the first piston responsive to the pressure applied by the surface pump to the conduit and moving the fluid out of the pump body into the conduit upon termination of the surface pump activation.

7. The apparatus of claim 4, wherein the subsurface pump further comprises:

a first check valve in communication with the conduit to permit fluid to flow from the conduit into the fluid chamber; and a second check valve in communication between the fluid chamber and the exterior of the pump body to terminate a gas lock of the fluid chamber.

* * * * *